US005318077A

United States Patent [19]

Yamashita

[11] Patent Number: 5,318,077

[45] Date of Patent: Jun. 7, 1994

[54] ABRASION DETECTOR FOR A RAPIER BAND

[75] Inventor: Ryoji Yamashita, Kanazawa, Japan

[73] Assignee: Tsudakoma Kogyo Kabushiki Kaisha, Japan

[21] Appl. No.: 942,626

[22] Filed: Sep. 9, 1992

[30] Foreign Application Priority Data

Sep. 11, 1991 [JP] Japan ..... 3-260956

[51] Int. Cl.[5] ..... D03D 47/27

[52] U.S. Cl. ..... 139/449; 198/810; 356/381

[58] Field of Search ..... 198/810; 139/449; 356/381

[56] References Cited

U.S. PATENT DOCUMENTS

| | | | |
|---|---|---|---|
| 4,371,482 | 2/1983 | Farabaugh | 356/381 X |
| 4,564,053 | 1/1986 | van Bogaert . | |
| 4,570,684 | 2/1986 | Feigl | 139/449 |
| 4,982,767 | 1/1991 | Pezzoli et al. | 139/449 |
| 5,075,622 | 12/1991 | Konii et al. | 356/381 X |

FOREIGN PATENT DOCUMENTS

| | | | |
|---|---|---|---|
| 434044 | 2/1992 | Japan | 139/449 |

*Primary Examiner*—Andrew M. Falik

*Attorney, Agent, or Firm*—Lerner, David, Littenberg, Krumholz & Mentlik

[57] ABSTRACT

In detention of abrasion on a rapier band controlled in reciprocation by a rapier guide, the principal of detection is closely related to the critical abrasion ($\alpha$) of the rapier band and the system calls for no substantial modification in construction of the rapier band in production. In a first embodiment, a longitudinal channel of a depth greater then the critical abrasion is formed in the guide face of the rapier guide so that an abrasion sensor attached to the rapier guide detects the dimension of a non-abraded region on the rapier guide projecting into the channel. In a second embodiment, a photoelectric sensor is attached to the rapier guide so that its detection beam passes through the rapier band at a distance of $\beta$ from the guide face, $\beta$ being equal to a sum of the critical abrasion ($\alpha$) and the initial gap between the rapier band and the guide face of the rapier guide. The critical abrasion ($\alpha$) of the rapier band can be easily and freely adjusted by end users only by changing the position of the sensor or sensors.

10 Claims, 4 Drawing Sheets

ABRASION DETECTOR FOR A RAPIER BAND

BACKGROUND OF THE INVENTION

The present invention relates to an abrasion detector for a rapier band on a rapier loom, and more particularly relates to an improvement in detection of abrasion of a rapier band used for reciprocation of a rapier head on a rapier loom.

In general on a rapier loom, each weft is inserted into an open shed by means of a rapier head, i.e. an weft gripper, reciprocating in the weft direction. The rapier head is driven for reciprocation by a rapier band, i.e. a tape, which cooperates with an oscillating band wheel, i.e. a driving wheel.

In the following description, the term "critical abrasion" refers to a limit of abrasion of a rapier band beyond which the rapier band cannot exhibit its expected function. Generally, the critical abrasion of a rapier band is 1 mm or smaller. In practice, however, the critical abrasion of a rapier band is not fixed but more or less varies depending upon process conditions and/or user's requirements. The term "guide face" refers to the face of a rapier guide which causes abrasion of a rapier band through its direct surface contact.

A wide variety of systems have been developed for detection of abrasion of rapier bands. In most cases, some modifications are applied to rapier bands. One typical example disclosed in Japanese Patent Laid-open Hei. 2-14045 on "A strap for controlling movement of an weft gripper on a shuttleless loom. In the case of this prior art system, a strap is embedded in a rapier band while extending in the longitudinal direction of the latter. The strap is made of a material which allows transmission of optical, electric or magnetic signals. The system further includes a detection head which is arranged in a face to face relationship to the rapier band incorporating the above-described strap. The depth of the strap embedded in the rapier band is chosen so that the strap is exposed on the surface of the rapier band when abrasion of the latter exceeds the prescribed critical abrasion. Surface exposure of the strap is sensed by the detection head and translated into accurance of excessive abrasion.

In the case of this prior art system, incorporation of the separate strap into the rapier band causes significant rise in cost due to its complicated construction. Since a rapier band is a sort of consumative product, its high production cost is a serious disadvantage in marketing. Further, since the critical abrasion is in general very small in dimension, accuracy in detection is greatly swayed by accuracy in production of the strap and/or accuracy in incorporation of the strap in the rapier band. As a result, no high degree of reliability in detection is in general expected. The strap is embedded into the rapier band during production of the latter. Stated otherwise, the critical abrasion of the rapier band is fixed at the stage of production and no free adjustment by users is accepted.

SUMMARY OF THE INVENTION

It is the basic object of the present invention to enable detection of rapier band abrasion with high degree of reliability and no substantial modification in construction of a rapier band itself.

It is another object of the present invention to enable free adjustment in critical abrasion of a rapier band even by users.

In accordance with the first basic concept of the present invention, a longitudinal channel is formed in the guide face of a rapier guide facing an associated rapier guide, the depth of the channel is set greater than the prescribed critical abrasion of the rapier band, and a critical abrasion sensor is attached to the rapier guide. The channel is most generally defined by a pair of side walls and a bottom wall. The channel may be defined by a side wall and a bottom wall. The channel may further has a bottomless construction. It is only required that the guide face of a rapier guide should have a width region not contacting an associated rapier band.

In the case of the above-described construction, abrasion of the rapier band advances during long use in a width region or regions in contact with the guide face of the rapier guide but no abrasion starts in the width region corresponding in position to the channel in the guide face of the rapier guide. As a result, a longitudinal crest is developed on the second width region of the rapier band which projects into the channel in the guide face of the rapier guide. When the height of the longitudinal crest equals the critical abrasion, presence of such a longitudinal crest is detected by the critical abrasion sensor. The channel in the guide face of the rapier guide spans a prescribed distance in the longitudinal direction of the rapier guide so that a longitudinal crest is developed on the rapier band in the width region corresponding to the channel. It is not always required that the channel should span the entire length of the rapier guide. At acceleration of a rapier band, only one part of the rapier band comes into sliding contact with the guide face of an associated rapier guide. When the channel in the guide face spans the entire length of the sliding contact, absence of the guide face in the region of the channel develops a longitudinal crest on the surface of the rapier band.

In accordance with the second basic concept of the present invention, a photoelectric sensor is attached to a rapier guide in an arrangement such that the axis of a detection beam from the photoelectric sensor should pass an associated rapier band at a position of $\beta$ from the guide face of the rapier guide, $\beta$ being equal to the sum of the critical abrasion of the rapier band with the initial gap between the rapier band and the guide face of the rapier guide.

In the case of this construction, the detection beam is intercepted by the rapier band as long as its abrasion falls short of the critical abrasion. Once its current abrasion exceeds the critical abrasion, interception by the rapier band disappears thereby enabling abrasion detection.

DESCRIPTION OF THE PREFERRED EMBODIMENTS

Figure 1:
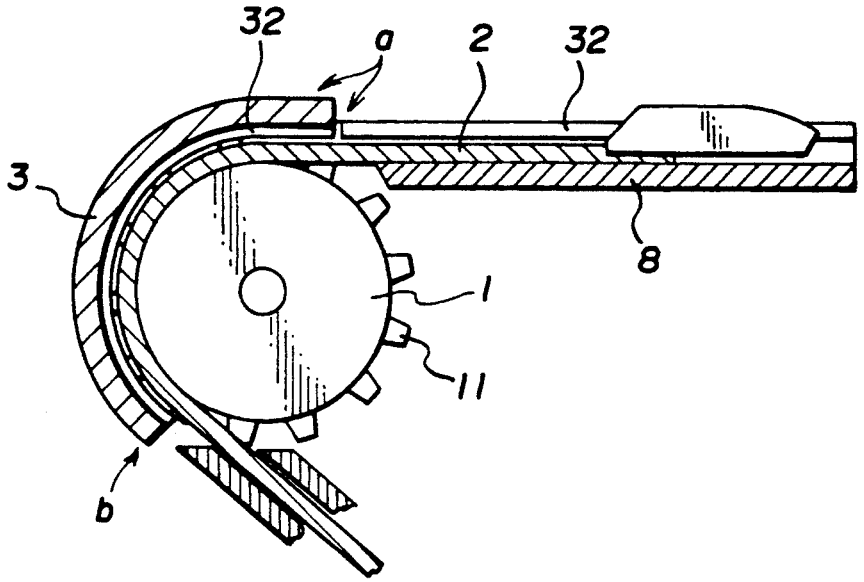
FIG. 1 is a side view, partly in section, of a rapier band in cooperation with a rapier guide.

As shown in FIG. 1, a rapier band 2 is driven for receiprocation through its engagement with a band wheel 1 arranged on one side of a loom for transportation of a rapier head in the weft direction. Curved and linear rapier guides 3 and 8 are arranged to properly control the reciprocation of the rapier band. For drive engagement with the rapier band 2, a number of teeth 11 project radially on the periphery of the band wheel 1 and a number of corresponding openings 23 (see FIG. 5) are formed in the rapier band 2 at substantially equal intervals along the length thereof. As the band wheel 1 rotates, teeth-opening engagement translates the wheel rotation into corresponding band reciprocation.

In accordance with the above-described first concept of the present invention, a longitudinal channel is formed in the guide face of a rapier guide facing an associated rapier band, the depth of the longitudinal channel is set greater than the prescribed critical abrasion ($\alpha$) of the rapier band, and a critical abrasion sensor is attached to the rapier guide 3 or 8.

Figure 2:
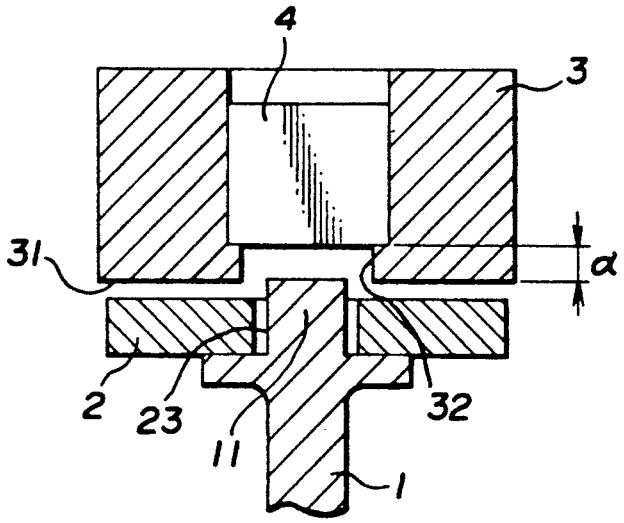
FIG. 2 is a transverse cross sectional view of one embodiment of the abrasion detector in accordance with the present invention.

One embodiment of the abrasion detector in accordance with the present invention is shown in FIG. 2, in which a pressure sensor 4 is used for the critical abrasion sensor. A longitudinal channel 32 is formed in the guide face 31 of a rapier guide 3 about the middle of its width. In the case of the illustrated example, the channel 32 is formed through the entire thickness of the rapier guide 3 and the pressure sensor 4 is inserted firmly into the channel 32. The pressure sensor 4 is positioned such that its detection head is at a distance of $\alpha$ (the critical abrasion) from the guide face 31 of the rapier guide 3. In the case of the illustrated example, the channel 2 spans substantially the entire length of the rapier guide 3. Because the rapier band 2 is prone to sliding at end "a" of rapier guide 3, it is preferred to arrange a sensor 4 near end "a".

Figure 3:
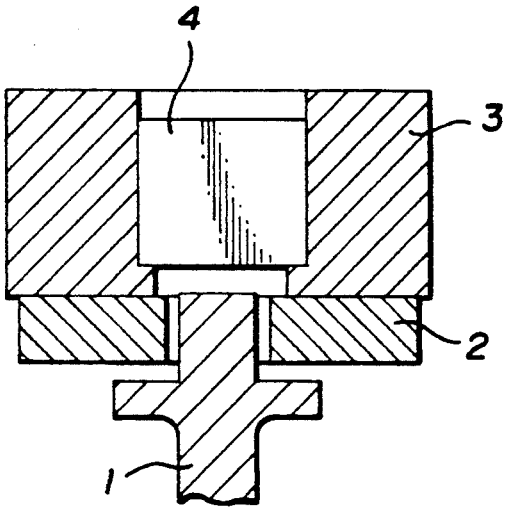
FIGS. 3A and 3B are transverse cross sectional views for showing the operation of the abrasion detector shown in FIG. 2.
Figure 3:
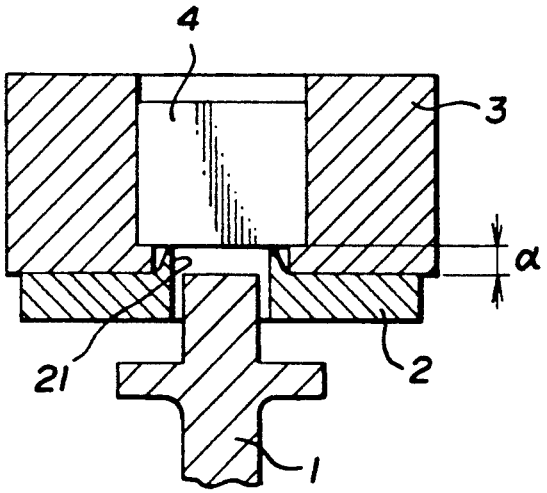
Figure 5:
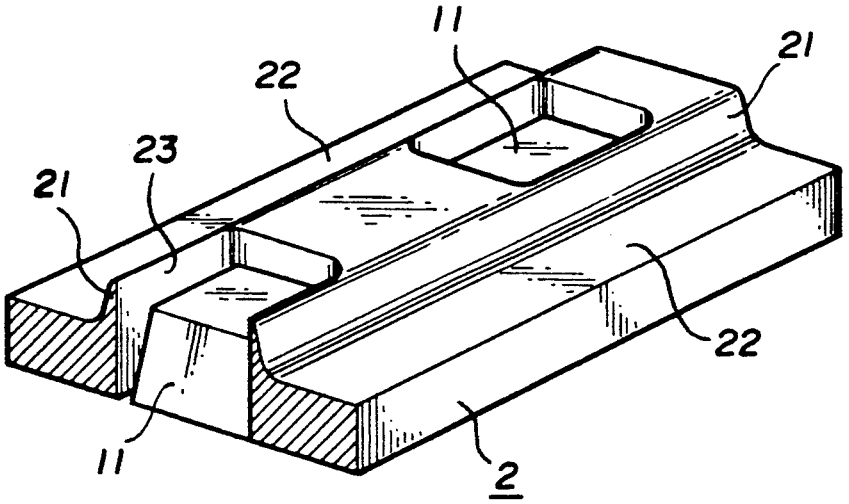
FIG. 5 is a perspective view of one example of abrasion advanced on a rapier band.

During long use of the rapier band 2, abrasion gradually advances in the width regions in sliding contact with the guide face 31 of the rapier guide 3 and no abrasion starts in the other width region out of sliding contact with the guide face 31. As a result, the working surface of the rapier band 2 assumes a condition such as shown in FIG. 5. More specifically, a non-abraded center regions 21 and abraded side regions 22 are present on the working surface of the rapier band 2 and the non-abraded region 21 takes the form of a longitudinal crest which projects into the channel 32 in the rapier guide 3. Development of such a longitudinal crest, i.e. the non-abraded region 21, is shown in FIGS. 3A and 3B. When the height of the crest, i.e. the non-abraded region 21, equals the critical abrasion ($\alpha$), the top of the crest comes in contact with the detection head of the pressure sensor which thereupon detects the fact that abrasion of the rapier band has reached the critical level.

The channel 32 may span a part of the length of the rapier guide 3. As stated above, the rapier band 2 is liable to perform sliding contact with the guide face 31 of the rapier guide 3 near the end "a" during acceleration. When the channel 32 spans only the longitudinal section near the end "a" in contact with the rapier band, a crest-like, non-abraded region 21 can be also developed on the working surface of the rapier band 2.

The pressure sensor 4, i.e. the critical abrasion sensor, is activated basically during running of the loom. It may be activated, however, once every prescribed number of picks or once every prescribed length of time. In particular, it is preferable to activate the critical abrasion sensor during acceleration of the rapier band 2 between a prescribed crank angles for reciprocation of the rapier band 2.

Detection can be carried out when the loom is out of running too. In this case, a longitudinal channel is formed in the guide face of the rapier guide 8 and the pressure sensor 4 is arranged therein. A retractable roller is arranged below the rapier band 2. When the loom ceases its running, the roller projects to press the lower surface of the rapier band 2. In addition to the one end "a" of the rapier guide 3, the rapier band 2 tends to slide near the other end "b" of the rapier guide 3. An additional pressure sensor may be arranged near this end "b" of the rapier guide 3 so that at least one of the pressure sensors should alert occurance of the critical abrasion.

Figure 4:
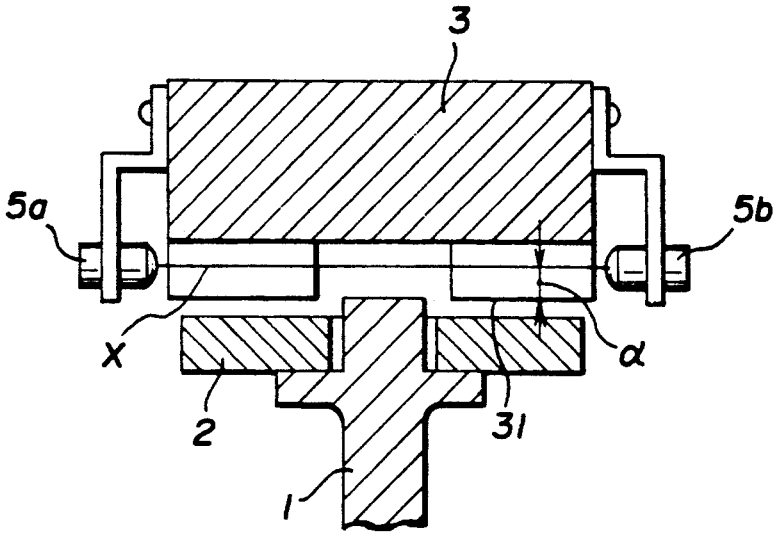
FIG. 4 is a transverse cross sectional view of another embodiment of the abrasion detector in accordance with the present invention.

As a substitute for the pressure sensor 4 in FIG. 2, a photoelectric sensor may be used for detection of abrasion. One embodiment of this type is shown in FIG. 4, in which the photoelectric sensor is made up of a light projector 5*a* and a light receiver 5*b*. In this case, the light projector and receiver are arranged so that the detection beam traveling between them should be positioned at a distance of $\alpha$, i.e. the critical abrasion, from the guide face 31 of the rapier guide 3.

As in the foregoing cases, a crest-like, non-abraded region 21 is developed on the working surface of the rapier band 2 after long use (see FIG. 5). As a rapier band 2 is abraded, but before the level of abrasion reaches a critical level, i.e. critical abrasion (a) the crest-like non-abraded region 21 of the rapier band remains too small to interrupt a detection beam traversing the longitudinal channel from light projector 5*a* to light receiver 5*b*. As the current abrasion reaches the critical abrasion, the detection beam is intercepted by the higher non-abraded region 21 for detection of occurance of the critical abrasion.

As a further substitute for the pressure sensor 4 in FIG. 2, a distance sensor may be arranged directing the top face of the rapier band 2 in order to detect the distance between the top surface of the rapier band 2 and the guide face 32 of the rapier guide 3 or 8. In this case, the detection head of the distance sensor is positioned at a distance larger then the critical abrasion ($\alpha$) from the guide face 31 of the rapier guide 3. An alert is issued when the distance between the top surface of the rapier band 2 and the guide face 32 reaches the critical abrasion.

Figure 6:
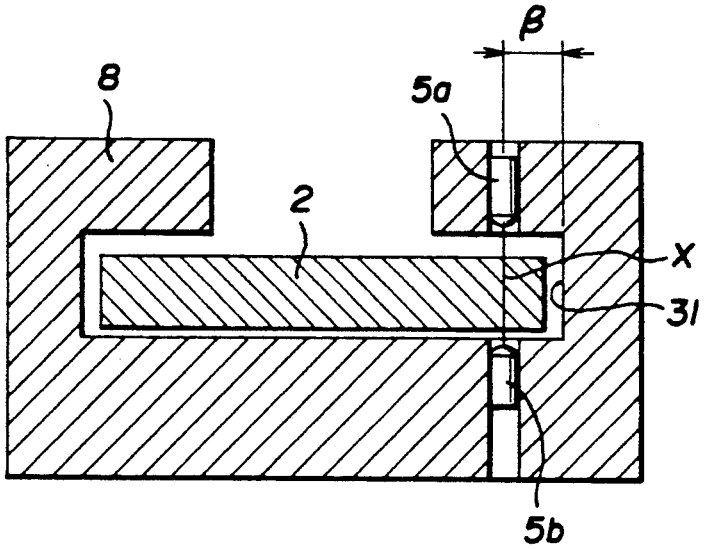
FIG. 6 is a transverse cross sectional view of the other embodiment of the abrasion detector in accordance with the present invention.

In accordance with the second basic concept of the present invention, a photoelectric sensor 5 is attached to a rapier guide in an arrangement such that the axis of its detection beam should pass through an associated rapier band 2 at a distance of $\beta$ from the guide face 31 of the rapier guide 8. Here, $\beta$ is equal to a sum of the critical abrasion ($\alpha$) of the rapier band 2 with an initial gap between the rapier band 2 and the guide face 31 of the rapier guide 8. One embodiment of the abrasion detector of this type is shown in FIG. 6, in which the photoelectric sensor 5 is made up of a pair of spaced and opposed light projector 5*a* and light receiver 5*b*. The light projector 5*a* and receiver 5*b* are mounted to the rapier guide 8 in an arrangement such that the axis X of the detection beam runs in parallel to the guide face 31 of the rapier guide 8 while passing, in the thickness direction, through an associated rapier band 2. In this case, the working surface of the rapier band 2 is taken on one of its lateral side surfaces. As long as the current abrasion on the working surface of the rapier band 2 falls short of the critical abrasion ($\alpha$), the detection beam from the light projector 5*a* is intercepted by the rapier band 2 without arrival at the light receiver 5*b*. When the current abrasion equals the critical abrasion ($\alpha$) of the rapier band 2, the detection beam arrives at the light receiver 5*b* without any interception and occurance of the critical abrasion is alerted.

The working surface may be taken on the top or bottom surface of the rapier band 2 too. In this case, the photoelectric sensor is mounted to the rapier guide 8 in an arrangement such that the axis X of its detection beam passes, in parallel to the lower guide face 32, through the rapier band 2 at a distance of $\beta$ from the guide face 32 of the rapier guide 8, $\beta$ being equal to a sum of the critical abrasion ($\alpha$) of the rapier band 2 with an initial gap between the rapier band 2 and the guide face 31.

A certain amount of initial gap is in general reserved between the rapier band 2 and the rapier guide 3. In the case of the present invention of the first basic concept, presence of such an initial gap need not be taken into consideration. This is because the extent of non-abrasion, i.e. the dimension of the non-abraded region 21, is used for detection. As a consequence, attention is focussed upon the critical abrasion ($\alpha$) in the case of the invention of the first basic concept. In contrast to this, the extent of abrasion, i.e. the dimension of the abraded region 22, is used for detection in the present invention of the second basic concept. As a consequence, presence of the above-described initial gap must be taken into consideration and attention is focussed upon the above-described sum $\beta$.

Figure 7:
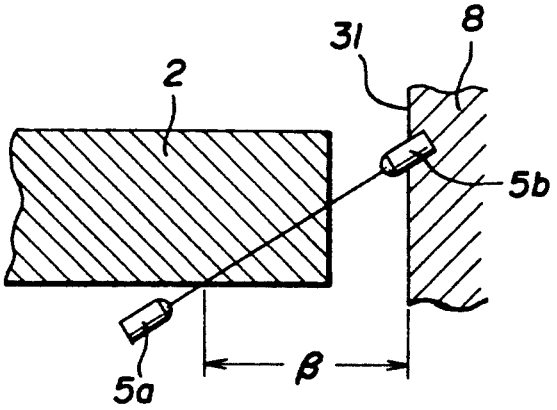
FIG. 7 is a transverse cross sectional view of a still other embodiment of the abrasion detector in accordance with the present invention.

In the case of the embodiment shown in FIG. 7, the light projector 5*a* and light receiver 5*b* are arranged so that the axis X of the detection beam runs aslant the guide face 31 of the rapier guide 8. In addition, the system is constructed so that the axis X of the detection beam should get into the rapier band 2 at a distance of the sum $\beta$ from the guide face 31. With the system so designed, not only abrasion on one lateral side surface but also abrasion on top or bottom surface of the rapier band 2 can be detected concurrently.

In one modification of the arrangement shown in FIG. 7, two sets of like photoelectric sensors may be arranged on different lateral sides of the rapier band 2 so that an alert should be issued when one of the photoelectric sensors detects occurance of the critical abrasion. This arrangement is particularly advantageous when abrasion on the top or bottom surface of the rapier band is inclined in the width direction.

In accordance with the present invention, no modification in construction needs to be made in production of rapier bands, which incurs no substantial rise in production cost. Accuracy in detection is not influenced at all by accuracy in production of rapier bands, thereby assuring high degree of accuracy in detection of abrasion. Adjustment in critical abrasion can be performed quite easily and freely even by end users through change in position of the critical abrasion sensor on a rapier guide.

I claim:

1. In a rapier loom including a rapier band, the improvement comprising: an abrasion detector for detecting abrasion on said rapier band including a rapier guide for guiding said rapier guide having a guide face in which is formed a longitudinal channel of a depth greater than a prescribed critical abrasion $\alpha$ of said rapier band, and a critical abrasion sensor associated with said rapier guide, so as to detect critical abrasion of said rapier band, said rapier band being capable of being abraded by contact with said guide face of said rapier guide.

2. The abrasion detector of claim 1 wherein said critical abrasion sensor is disposed in said channel of said detector at a distance of $\alpha$ from said guide face of said rapier guide.

3. The abrasion detector of claim 1 wherein said critical abrasion sensor is a photoelectric sensor, said photoelectric sensor being disposed in said detector such that an axis of said photoelectric sensor's detection beam is positioned across said longitudinal channel at a distance of $\alpha$ from said guide face of said rapier guide.

4. The abrasion detector of claim 1 wherein said critical abrasion sensor is disposed in said detector at a distance of $\alpha$ from said guide face of said rapier guide.

5. The abrasion detector of claim 1 wherein said critical abrasion sensor includes a photoelectric sensor having at least one projector of electromagnetic energy and at least one receiver of electromagnetic energy, said projector and receiver being disposed in said detector such that electromagnetic energy passing therebetween would be blocked by a rapier band disposed in said rapier guide having less than said prescribed critical abrasion $\alpha$.

6. An abrasion detector for detecting the abrasion of a rapier band comprising:

a rapier guide having a first guide face and a second guide face substantially perpendicular to said first guide face, and at least one photoelectric sensor associated with said rapier guide including a projector for electromagnetic energy and a receiver for electromagnetic energy, said photoelectric sensor being disposed in said detector at a distance of $\beta$ from said second guide face, said distance $\beta$ being equal to a critical abrasion $\alpha$ of a rapier band.

7. The abrasion detector of claim 6 wherein said projector and receiver are disposed in said detector so as to provide for the transmission of electromagnetic energy from said projector to said receiver of said photoelectric sensor in a direction substantially parallel to said second guide face of said rapier guide.

8. The abrasion detector of claim 6 wherein said projector and receiver are disposed in said detector so as to provide for the transmission of electromagnetic energy from said projector to said receiver of said photoelectric sensor in a direction substantially oblique to said second guide face of said rapier guide.

9. The abrasion detector of claim 8 wherein a plurality of photoelectric sensors are disposed cooperatively along said rapier guide.

10. In combination with a rapier band an abrasion detector for detecting the abrasion of said band comprising a rapier guide having a first guide face and a second guide face substantially perpendicular to said first guide face, and at least one photoelectric sensor including a projector for electromagnetic energy and a receiver for electromagnetic energy, said photoelectric sensor being disposed at a distance of $\beta$ from said second guide face, said distance $\beta$ being equal to a critical abrasion $\alpha$ of said rapier band; and said rapier band being of a size and shape sufficient to interrupt the transmission of electromagnetic energy from said projector to said receiver until said critical abrasion $\alpha$ is reached.

* * * * *